United States Patent [19]

Larsson

[11] 4,174,822

[45] Nov. 20, 1979

[54] SHOWER HOLDER

[76] Inventor: Nils Larsson, Dalävagen 50, Västra Frölunda, Sweden, 421 68

[21] Appl. No.: 831,927

[22] Filed: Sep. 9, 1977

[30] Foreign Application Priority Data

Sep. 17, 1976 [SE] Sweden ..... 7610371

[51] Int. Cl.[2] ..... B05B 15/06

[52] U.S. Cl. ..... 248/75; 4/145; 248/229; 248/231; 248/279; 248/314

[58] Field of Search ..... 248/75, 229, 230, 231, 248/279, 283, 314, 225.3, 288 B, 74 PB, 218.4; 4/145; 239/282, 283, 588

[56] References Cited

U.S. PATENT DOCUMENTS

| | | | |
|---|---|---|---|
| 814,613 | 3/1906 | Mackean | 248/231 X |
| 935,416 | 9/1909 | Schneider | 248/279 |
| 973,319 | 10/1910 | Thunen et al. | 248/230 |
| 1,690,491 | 11/1928 | Knauff | 248/229 |
| 2,471,627 | 5/1949 | Kalter | 248/218.4 |
| 2,621,968 | 12/1952 | Vickroy | 248/229 X |
| 2,704,963 | 3/1955 | Parachek | 248/279 |
| 2,927,807 | 3/1960 | Campbell | 151/19 R |
| 3,843,083 | 10/1974 | Angibaud | 248/229 |
| 3,979,096 | 9/1976 | Zieger | 248/75 |

FOREIGN PATENT DOCUMENTS

| | | | |
|---|---|---|---|
| 66600 | 4/1957 | France | 4/145 |
| 1252142 | 12/1960 | France | 4/145 |
| 536157 | 11/1955 | Italy | 248/75 |

*Primary Examiner*—Rodney H. Bonck
*Attorney, Agent, or Firm*—Holman & Stern

[57] ABSTRACT

The invention provides a simplified shower holder combination adapted to be easily adjustable and the shower holder comprises a bracket member slidably and pivotably arranged on a wall-attached bar, said bracket member having a pivot shaft whereupon a shower handle holder is fitted, clamping means being arranged for simultaneously arresting the bracket in any selected position at said bar and the shower handle holder in any selected pivot position relative to said bracket.

4 Claims, 3 Drawing Figures

SHOWER HOLDER

BACKGROUND OF THE INVENTION

The present invention refers to a shower holder comprising in combination a bracket, a holder member for a shower handle attached to said bracket, an opening provided in said bracket for receiving a bar along which the said bracket in mounted position is slidable in a pivotable manner.

In conventional shower holders the bracket is usually fixed to the bar by means of a stop screw screwed into the bracket, one end of the stop screw contacting the bar and the other end of the stop screw being provided with a handle or the like. The holder for the shower handle is by means of a ball and socket joint rotatable in relation to the bracket.

This design is relatively expensive and it is therefore a purpose of the present invention to provide a shower holder, which is much cheaper to manufacture, and by means of which the bracket can be easily fixed to the bar and the shower handle to the bracket by just one hand grip.

SUMMARY OF THE INVENTION

This is according to the invention achieved thereby that the bracket incorporates a pair of mainly parallel shanks of a certain resiliency and projecting from said opening, said holder member being attached between said shanks and being connected thereto by means of a pivot pin, an adjustable tightening means being provided for adjusting the distance between said shanks for the purpose of clamping the bracket to the bar and simultaneously the shower handle to the bracket.

According to a preferred embodiment is the tightening means designed as a rotary member comprising a screw arranged to extend through at least one bore arranged in one of said shanks and to project into a second bore aligned with said first bore and provided in the second one of said shanks, said screw being arranged in thread engagement with at least said second bore and an actuating member such as a handle being provided for tightening said screw.

In another embodiment is the tightening means designed as a rotary member comprising tapering internal threads corresponding to tapering external threads provided at a portion of said shanks, said shanks being arranged to be received into the bore of said nut, which can be tightened for clamping said bracket to said bar and said shower handle to said bracket.

These are preferably provided grooves at the internal surface of the portions of said shanks between which said holder member is arrested, said holder member being provided with corresponding grooves at the surface thereof situated between said shank portions.

The holder member preferably has a width which decreases towards the free end at least over the portion to be clamped between said shanks, the shanks at this portion being spaced apart a distance mainly corresponding to the thinnest section of said holder member portion.

DESCRIPTION OF THE PREFERRED EMBODIMENTS

Figure 1:
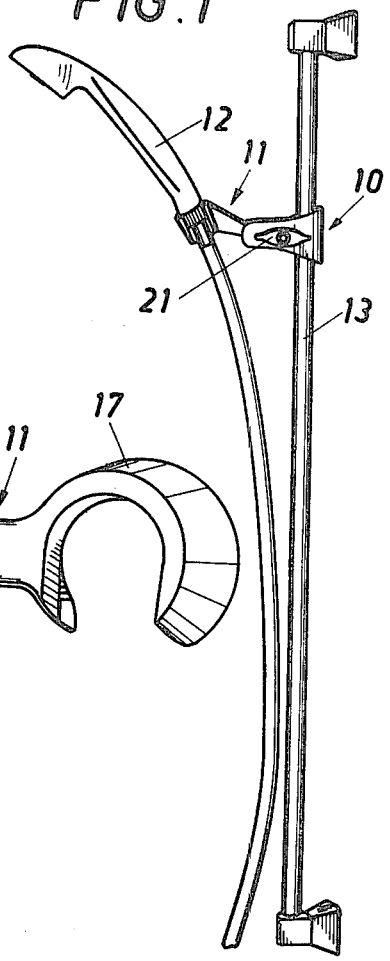
FIG. 1 is a perspective view of a shower attached to a bar by means of a shower holder according to the invention.

The shower holder comprises a bracket 10 and a holder member 11 for the shower handle 12. The bracket 10 is slidable along and pivoted about a vertical bar 13, so that the position of the shower handle 12 can be adjusted. The bracket 10 is provided with an opening 14 for the bar 13 and with a pair of substantially parallel shanks 15 extending from the opening 14.

The holder member 11 comprises an arm 16 attached between the shanks 15, said arm 16 at its free end being provided with a gripper 17 for the shower handle 12. The gripper 17 can be grooved inside for providing a better grip of the shower handle 12.

The shanks 15 have at its free ends a thinner thickness of material, so that an enlarged space is formed between the shanks, the arm 16 of the holder member 11 being attached in said space. Preferably the shanks 15 in said space are provided with internal grooves corresponding to grooves 18 on the part of the arm 16 being located between the shanks 15. A pin 19 extends through the shanks 15 and the arm 16, the arm 16 being pivoted about said pin 19. By the shanks 15 and the arm 16 being provided with grooves the holder member can be fixed in different positions about the pin 19.

Figure 2:
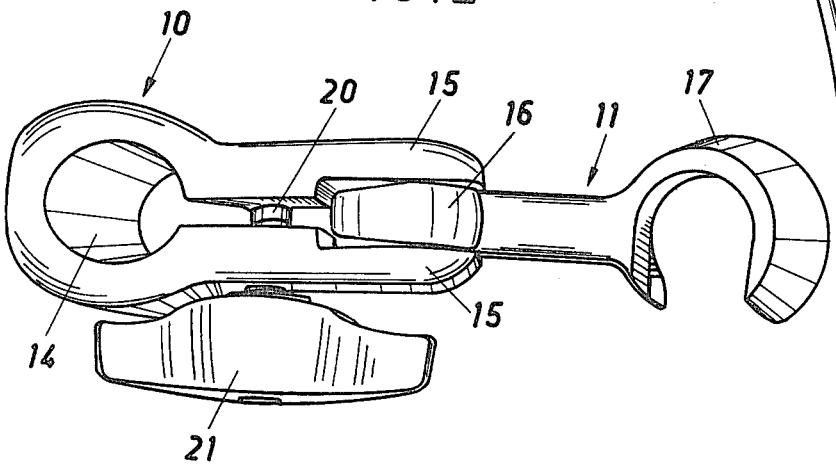
FIGS. 2 and 3 show the shower holder according to FIG. 1 but on a larger scale.
Figure 3:
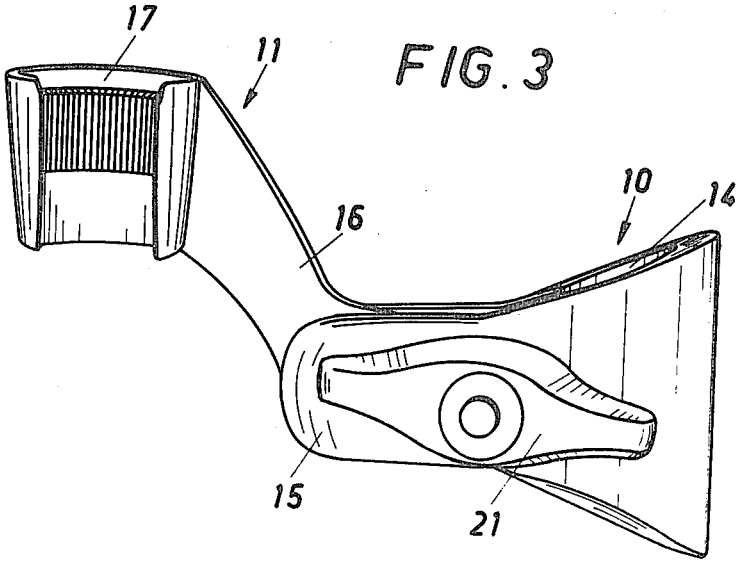
Figure 4:
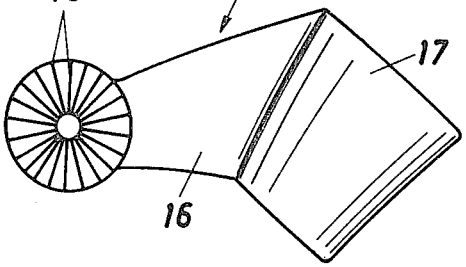
FIG. 4 is a side elevation of the holder member.

According to the embodiment of FIGS. 1–3 a screw 20 is screwed through one of the shanks 15 and part into the other shank. The screw 20 is provided with a handle 21. The screw 20 is arranged between the opening 14 and the enlarged space between the free ends of the shanks 15.

By tightening the screw 20 the shanks 15 are pressed together, at which the bracket 10 is fixed to the bar 13 at the same time as the holder member 11 is fixed to the bracket 10. When changing the position of the shower the screw 20 is undone so much that the desired adjustment can be made, after which the screw 20 is tightened again.

Figure 5:
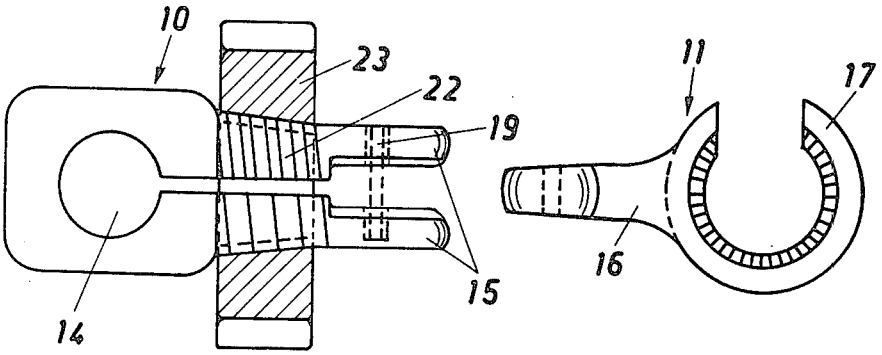
FIG. 5 is an exploded view of the shower holder according to another embodiment.
Figure 5:
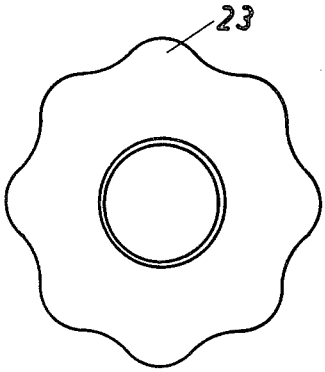

According to the embodiment of FIG. 5 a part of the shanks 15 are provided with tapered external threads 22 corresponding to tapered internal threads of a nut 23. By tightening the nut 23 the shanks 15 are pressed together, in the same way as described above, at which the bracket 10 is fixed to the bar 13 and the holder member 11 is fixed to the bracket 10.

The part of the arm 16 of the holder member 11 received between the shanks 16 can preferably have a width which decreases towards its free end, at which the distance between the shanks substantially corresponds to the width of the thinnest section of said part. When the holder member 11 is attached between the shanks 15 these are pressed apart at its outer part and the holder member 11 can be safely fixed in different positions about the pin 19 at the outer part of the shanks 15 even if the screw 20 or the nut 23 is not tightened.

The entire shower holder can be made of plastic, which means low manufacturing costs. Most of the plastic materials are flexible enough for providing the shanks 15 with the required resilience.

The embodiment is not limited to the described embodiments, but can be varied within the scope of the claims.

What I claim is:

1. A shower holder assembly comprising in combination an elongated bar, means for attaching said bar to a wall, a bracket, a holder member for a shower handle attached to said bracket, said bracket comprising a yoke-like member defining an opening receiving said bar, said bracket being slidable along said bar and rotatable about said bar, said bracket including a pair of generally parallel shanks extending from said opening, said holder member being attached between said shanks and being connected thereto by means of a pivot pin, said holder member including a gripping ring for the shower handle said ring being open on one side and an adjustable tightening means connected between said shanks for releasably clamping the bracket to the bar and simultaneously clamping the holder member in position in the bracket by adjusting the distance between the shanks, wherein the holder member has a width which decreases towards a free end at least over the portion of the holder between said shanks, said shanks being spaced apart a distance substantially equal to the thinnest part of said portion at said free end of said holder, whereby said shanks are force apart by said holder member portion such that the holder member remains fixed against unintentional pivotal movement even if said tightening means is loose for sliding adjustment of said bracket along said bar.

2. The shower holder assembly as claimed in claim 1, wherein the tightening means is a rotary member comprising a screw extending through a bore in one of said shanks and projecting into a second bore in the second one of said shanks, said screw being in threaded engagement with said second bore and an actuating member being provided for tightening said screw.

3. The shower holder assembly as claimed in claim 1, wherein the tightening means is a rotary member comprising a nut with a tapering threaded bore corresponding to tapering external threads provided on a portion of said shanks, said shanks being received in the bore of said nut.

4. The shower holder assembly as claimed in claim 1, wherein grooves are provided on internal surface portions of said shanks between which said holder member is arrested, said holder member being provided with corresponding grooves on surface means thereof situated between said shank portions.

* * * * *